US009761982B2

(12) United States Patent
Bertsch

(10) Patent No.: US 9,761,982 B2
(45) Date of Patent: Sep. 12, 2017

(54) PLUG CONNECTOR CONTACT CARRIER HAVING CRIMP AND SCREW CONTACT ELEMENT CHAMBERS

(71) Applicant: Amphenol-Tuchel Electronics GMBH, Heilbronn (DE)

(72) Inventor: Michael Bertsch, Heilbronn (DE)

(73) Assignee: Amphenol-Tuchel Electronics GMBH (DE)

( * ) Notice: Subject to any disclaimer, the term of this patent is extended or adjusted under 35 U.S.C. 154(b) by 0 days.

(21) Appl. No.: 15/037,788

(22) PCT Filed: Oct. 23, 2014

(86) PCT No.: PCT/DE2014/100379

§ 371 (c)(1),
(2) Date: May 19, 2016

(87) PCT Pub. No.: WO2015/078442

PCT Pub. Date: Jun. 4, 2015

(65) Prior Publication Data

US 2016/0301152 A1 Oct. 13, 2016

(30) Foreign Application Priority Data

Nov. 26, 2013 (DE) ..... 10 2013 019 695

(51) Int. Cl.
*H01R 29/00* (2006.01)
*H01R 13/426* (2006.01)
(Continued)

(52) U.S. Cl.
CPC ..... *H01R 13/426* (2013.01); *H01R 4/363* (2013.01); *H01R 4/4818* (2013.01); *H01R 9/24* (2013.01); *H01R 29/00* (2013.01)

(58) Field of Classification Search
CPC ..... H01R 4/363; H01R 4/4818; H01R 9/24; H01R 13/426; H01R 13/35; H01R 24/66;
(Continued)

(56) References Cited

U.S. PATENT DOCUMENTS 3,054,078 A * 9/1962 Baschkin ..... H01R 31/00 439/170
3,766,513 A * 10/1973 Carre ..... H01R 13/428 439/171
(Continued)

FOREIGN PATENT DOCUMENTS

DE 7135444 U 5/1972
DE 7701713 U1 6/1977
(Continued)

OTHER PUBLICATIONS

W02015078442 English Translation of Incoming Written opinion, May 19, 2016, 6 pages.*

*Primary Examiner* — Chandrika Prasad
(74) *Attorney, Agent, or Firm* — Blank Rome LLP

(57) ABSTRACT

The invention relates to a plug connector contact carrier (1) for selectively populating with electrical crimp contact elements (10) or electrical screw contact elements (20), comprising a plurality of contact chambers (2) for the contact elements, which contact chambers are provided in a contact grid, wherein the contact carrier has insertion openings (11) for inserting the contact elements into the contact chambers and wherein furthermore the contact chambers are property designed in such a way that selectively either a crimp contact element or a screw contact element can be inserted into and mounted in the contact chamber.

16 Claims, 6 Drawing Sheets

(51) Int. Cl.
*H01R 4/36* (2006.01)
*H01R 4/48* (2006.01)
*H01R 9/24* (2006.01)

(58) Field of Classification Search
CPC ..... H01R 27/00; H01R 31/00; H01R 31/06; H01R 33/90; H01R 4/305
USPC ..... 439/518, 709
See application file for complete search history.

(56) References Cited

U.S. PATENT DOCUMENTS 5,037,336 A 8/1991 Betsui
6,027,368 A * 2/2000 Daoud ..... H01R 9/2416 439/532
6,252,941 B1 * 6/2001 Daoud ..... H04M 1/24 379/19
7,448,894 B2 11/2008 Tsuji et al.
8,193,467 B2 * 6/2012 Holaus ..... H01B 17/301 174/144
2004/0110427 A1 6/2004 Shi et al.
2005/0208828 A1 * 9/2005 Miller ..... H01R 9/0515 439/581
2006/0228949 A1 10/2006 Neese et al.
2008/0248698 A1 10/2008 Pizzi
2009/0311896 A1 12/2009 Myer et al.
2011/0065330 A1 * 3/2011 Miller ..... H01R 4/305 439/709
2012/0208396 A1 * 8/2012 Kashiyama ..... H01R 13/748 439/527
2016/0156122 A1 * 6/2016 Bouda ..... H01R 13/506 439/518

FOREIGN PATENT DOCUMENTS

DE 4030621 A1 4/1991
DE 3942519 A1 6/1991
DE 112005002830 T5 11/2007
DE 112009001472 T5 4/2011
EP 2034562 A2 3/2009

* cited by examiner

PLUG CONNECTOR CONTACT CARRIER HAVING CRIMP AND SCREW CONTACT ELEMENT CHAMBERS

RELATED APPLICATIONS

This application is a national phase of PCT/DE2014/100379, filed on Oct. 23, 2014, which claims the benefit of German Application No. DE 102013019695.7, filed on Nov. 26, 2013. The entire contents of those applications are incorporated herein by reference.

The invention relates to a plug connector contact carrier as claimed in claim 1.

The invention therefore relates to a plug connector contact carrier which is intended to be selectively populated with electrical crimp contact elements or electrical screw contact elements in a homogeneous manner or with mixed population.

The prior art contains a large number of different plug connections which generally have a plug connector housing in which a plug connector contact carrier is accommodated.

Industrial applications in particular contain a large number of modular plug connector systems which comprise a set of plug connector contact carriers which can be installed in different plug connector housings, that is to say in plug connector housings of different sizes.

Since there is a considerable need for plug connector solutions on account of the numerous different applications, there is an increasing requirement to reduce the number of and therefore the variety of parts in plug connections and to provide a plug connector system with which a large number of different application solutions can be realized with one plug connector contact carrier.

The question of which contact system is used is also dependent on the respective application. The prior art contains, for example, solder contact elements, crimp contact elements and furthermore the widespread screw contact elements. The plug connector systems known in the prior art each have plug connector contact carriers which are designed in order to receive, for example, only screw contact elements or only crimp contact elements.

If, however, a user requires a plug connector contact carrier for use with crimp contact elements with similar equipment, he has to switch to a second component, specifically to a plug connector contact carrier which is designed explicitly for crimp contact elements.

Since the number of poles also varies depending on the application, this results in a significant variety of parts.

A further requirement in the prior art is that of advantageously using screw contact elements for certain electrical circuits, while crimp contact elements should preferably be used for other electrical or signal circuits.

However, the plug connectors known from the prior art do not provide the possibility of mixed population of the contact carrier both with screw contact elements and with crimp contact elements either. Instead, it is necessary to provide different sizes of contact carriers which are then jointly accommodated in a plug connector housing in an appropriate combination with one another such that the configuration required for the respective application is acquired.

Against this background, the object of the present invention is to provide a plug connector contact carrier which is intended to be selectively populated, and in particular populated in a mixed manner, with electrical crimp contact elements or electrical screw contact elements in order to reduce the large number of parts, to improve the handleability of the plug connections and to be able to accommodate a combination of screw contact elements and crimp contact elements desired for the application in a single plug connector.

This invention is achieved by a plug connector contact carrier having the features of claim 1.

The basic idea of the present invention is that of providing a plug connector contact carrier having a large number of contact chambers, wherein, according to the invention, the contact chambers are designed such that both a screw contact element and a crimp contact element can be mounted selectively in the same contact chamber.

As a result of this, the user of the plug connector contact carrier according to the invention is free to populate said plug connector contact carrier either exclusively with screw contact elements or exclusively with crimp contact elements or else with a mixture of said contact elements.

Therefore, in an extremely general embodiment of the invention, provision is made to provide the contact chamber with a defined intended bearing surface against which either the respective inserted crimp contact or the screw contact, depending on which of the two contacts is inserted into the contact chamber, is supported in a defined mounting plane. This provides a defined mounting plane, so that the length of the contact parts with which contact is intended to be made can likewise be selected such that a common plug-connection plane for all contacts is achieved. This prevents, for example, the screw contacts coming into electrical contact with a corresponding mating plug connector before or after the crimp contacts.

Therefore, according to the invention, a plug connector contact carrier which is intended to be selectively populated with electrical crimp contact elements or electrical screw contact elements and which has a large number of contact chambers for the contact elements, which contact chambers are provided in a contact grid, is provided in the most general form of the invention, wherein the contact carrier has insertion openings for inserting the contact elements into the contact chambers, wherein furthermore the contact chambers are designed, as intended, such that selectively either a crimp contact element or a screw contact element can be inserted into and mounted in the contact chamber.

In the preferred embodiment of the invention, the contact chambers have a common bearing surface for a corresponding mating surface to bear against the crimp contact element or the screw contact element which can be selectively inserted.

In a further preferred embodiment of the invention, the plug connector contact carrier has an end side, a contact insertion side which is situated opposite the end side and on which the above-described openings for inserting the contacts are arranged, and two longitudinal sides which each connect the end side and the contact insertion side, wherein in each case lateral connecting channels to the contact chambers with openings which open out into the longitudinal sides are provided in the plug connector contact carrier, it being possible for a screwdriver to be inserted into said openings in order to be able to operate the screw terminal of a screw contact which is mounted in the contact carrier.

According to the invention, provision is further made for the plug connector contact carrier to have at least one detachable holding cover in order to secure the crimp contact elements which are mounted in the contact carrier in their mounting position.

In this case, the size of the holding cover is scalable in order to in each case cover only the relevant sections depending on the level of population of the plug connector contact carrier with crimp contact elements. In other words, this means that the contact chambers which are populated with screw contacts are not provided with the above-described holding cover.

In a preferred embodiment of the invention, the holding cover has a head plate with a large number of openings which are arranged in the same contact grid as the contact grid of the contact carrier.

Furthermore, the holding cover is preferably formed with an approximately U-shaped cross section, so that two limb sides which project away from the head plate in an orthogonal manner are provided. In this way, it is possible to ensure that the connecting channels to the contact chambers are covered by means of the limb sides provided that the limb sides are of corresponding length.

In a preferred embodiment of the invention, provision is further made for the holding cover to have arms which project away from the head plate and which are attached to the holding cover adjacent to the openings in such a way that said arms respectively protrude into the contact chambers when the holding cover is mounted on the plug connector contact carrier in order to be supported by way of their end against a latching surface on the crimp contact in said contact chambers and to secure said crimp contact in its mounting position.

Provision is further advantageously made for the arms to have a bent or angled profile. In this way, it is possible to ensure that the crimp contacts are fixed at a defined holding point by the ends of the arms.

In a particularly preferred embodiment of the invention, the arms are each arranged between the openings and the respectively adjacent limb sides.

This means, for example when the contact chambers are arranged in two rows, that one row of openings for the crimp contacts is provided adjacent to a second row of openings for the crimp contacts in the holding cover. Adjacent to each of these rows of openings, the above-described arms are arranged between the positions of these openings and the respective limb sides such that the arms protrude into the contact chambers as soon as the holding cover is mounted as intended on the plug connector contact carrier.

Provision is further advantageously made for the limb sides of the holding cover to be provided with latching lugs on their sides which face the plug connector contact carrier for the purpose of latching with corresponding latching recesses which are provided on the corresponding longitudinal sides of the plug connector contact carrier.

Provision is further advantageously made for further openings to be provided in the head plate of the holding cover adjacent to the above-described openings which are arranged in the contact grid of the plug connector contact carrier, preferably in each case one further opening for each opening for the contact elements.

In this way, it is possible to ensure that contact insertion side of the plug connector contact carrier, which contact insertion side is situated opposite the end side, is provided with a contact chamber identification means which are visible through the above-described openings even in the mounted state of the holding cover. In other words, the last-mentioned openings serve as windows for providing a clear view of the plug connector contact carrier which is provided with contact chamber identification means.

In a further preferred embodiment, in addition or as an alternative to the above-described holding cover, a similarly detachable (further) holding cover which is provided with wire protection means is provided in order to provide the screw contact elements which are mounted in the contact carrier with wire protection in each case. Therefore, it is possible to selectively populate, for example, the entire contact carrier by means of crimp contacts and to provide a holding cover for the crimp contacts, which holding cover correspondingly covers the entire contact carrier. As an alternative, the plug connector contact carrier can be provided with a holding cover having wire protection means, as described last, as soon as the plug connector contact carrier is populated exclusively with screw contact elements.

In a further design of the invention, mixed population can also be provided, so that, for example, half of the plug connector contact carrier is populated with crimp contact elements and respectively a holding cover of appropriate dimensions and size is arranged in this region, while the second half of the plug connector contact carrier can be provided with screw contacts and the last-mentioned detachable holding cover with wire protection means of suitable dimensions can be mounted in this region. It is advantageous when the respective cover can be shortened to the desired length by the user, for example by way of predetermined breaking points.

When, according to the invention, both the holding cover for the crimp contacts and the holding cover with the wire protection means for the screw contacts have an identical contact grid, mixed population can be realized. Therefore, provision is advantageously made for the holding cover or each of the two holding covers to have openings in the contact grid of the contact chambers of the plug connector contact carrier. A further aspect of the present invention is that of providing a set comprising a contact carrier and the two types of holding cover (for the crimped design and the wire protection design).

Provision is further made for the holding cover which is provided with wine protection means to be provided with spring sheets which are mounted in corresponding receiving elements on the holding cover and which project from the holding cover such that said spring sheets respectively protrude into the contact chambers when the holding cover is mounted.

In a further preferred embodiment of the invention, the openings of the in the holding cover with the wire protection means are in the form of elliptical openings, wherein the large half-axes are arranged on a line in the longitudinal extent of the plug connector contact carrier. In a particularly preferred embodiment of the invention, the plug connector contact carrier has two parallel rows of contact chambers which are arranged in a fixed unchanging contact grid in relation to one another.

A further aspect of the present invention relates to the design of the holding covers which are lined up with one another in a particularly advantageous embodiment and therefore can be mounted on a rail. Owing to this particular design, the holding cover, in particular the holding cover which is provided with wire protection means, scaled to any desired length.

Therefore, by means of a linear forward movement, holding covers which are produced in strips can be cut to length and lined up with one another in a suitable length on the basis of the defined grid. Owing to this geometric design, it is possible to produce the wire protection means in an automated method, in particular with continuous flow production, and to provide the holding covers with wire protection means in a corresponding method.

There are further possible ways of advantageously configuring and developing the teaching of the present invention. To this end, reference is made firstly to the claims subordinate to independent claims and secondly to the following explanations of preferred embodiments of the invention.

Generally preferred refinements and developments are also explained in connection with the explanation of the preferred exemplary embodiments of the invention with reference to the drawings, in which.

Figure 1:
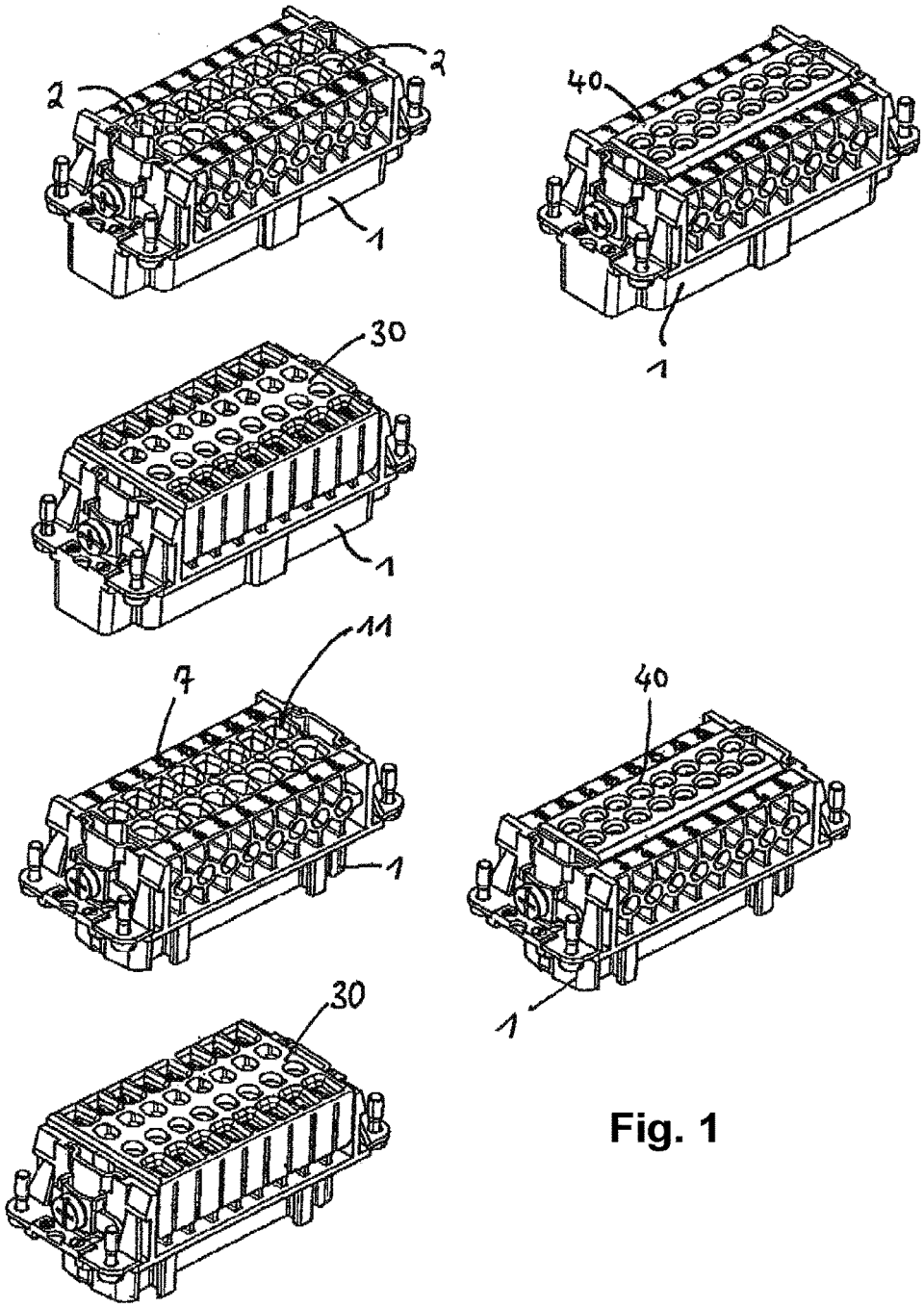
FIG. 1 shows an overview of different plug connector contact carriers with and without holding covers in perspective views.

FIG. 1 shows an exemplary embodiment of the plug connector contact carrier 1 according to the invention in several perspective views. In said figure, the plug connector contact carrier 1 is either free of or fitted with a holding cover 30 for crimp contacts or a holding cover 40 for screw contacts. The contact carrier 1 has two rows of contact chambers 2. Contact chamber identification means 7 are fitted adjacent to the contact chambers 2.

Figure 2:
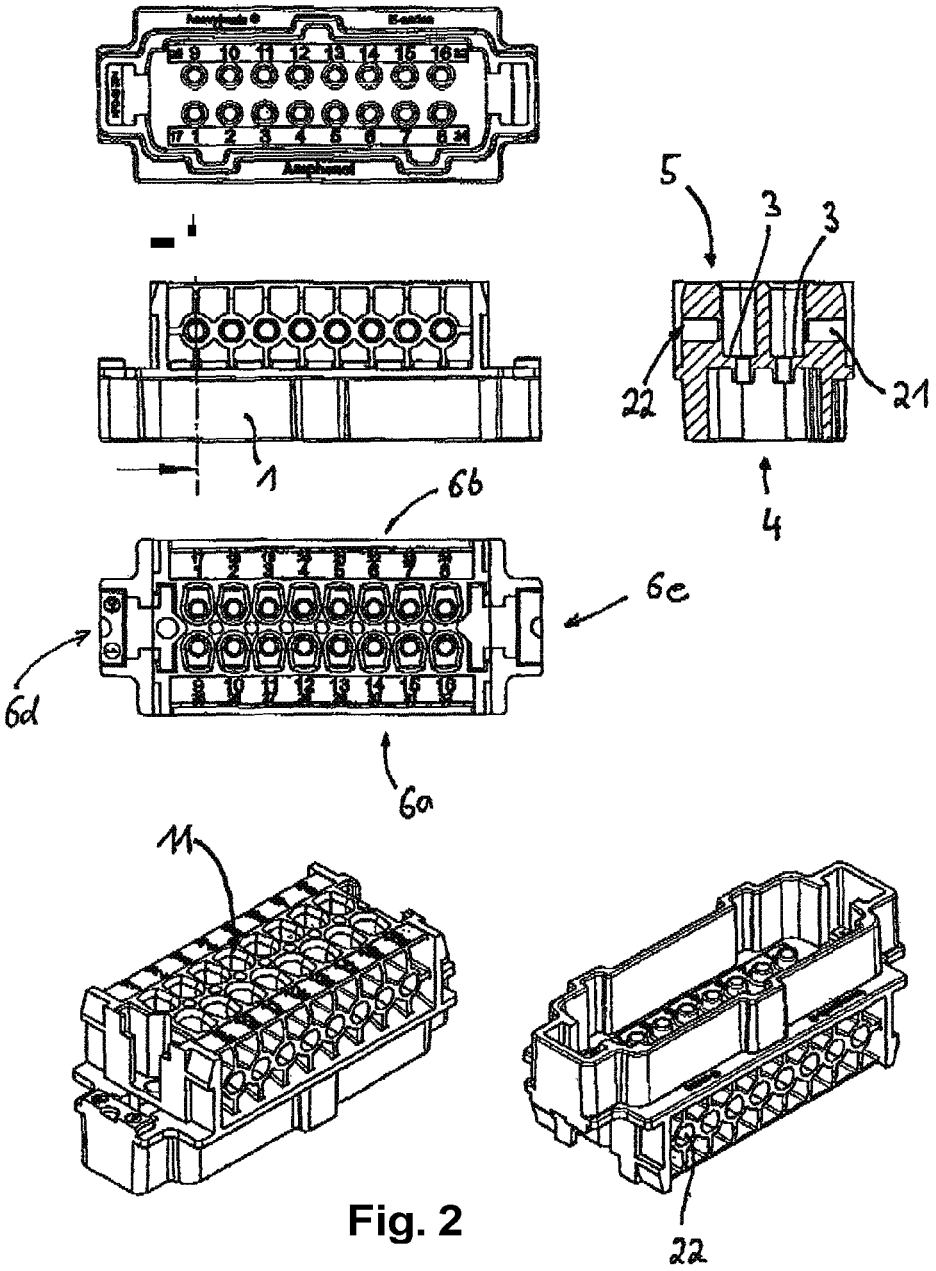
FIG. 2 shows different views of the plug connector contact carrier shown in FIG. 1 in a plan view, a side view, a view from above and a view from below and a sectional view.

As can further be seen in the various views of FIG. 2, the present exemplary embodiment in each case has a first row with eight contact chambers 2 and a second row with eight contact chambers 2, which second row is arranged parallel to said first row. The contact chambers 2 are accessible via insertion openings 11 into which selectively either a crimp contact element 10 or a screw contact element 20 can be inserted. Therefore, according to the invention, the contact chambers 2 are designed such that, irrespective of the different contact element form, selectively either a crimp contact element of a first contact form, as it were a first contact type, can be inserted into the contact chamber 2 of the plug connector contact carrier 1 or else, as an alternative, that is to say selectively, a screw contact element of a differing contact form, that is a different contact type, can be accommodated in the contact chamber 2 in a manner in which it can be inserted into or mounted in the contact chamber 2.

As is further schematically shown in the sectional view of FIG. 2, the contact chamber 2 has a common bearing surface 3 for either the crimp contact element 10 or the screw contact element 20 to bear against.

Therefore, the plug connector contact carrier 1 has an end side 4, a contact insertion side 5 which is situated opposite the end side 4, and two longitudinal sides 6*a*, 6*b* which connect the end side 4 and the contact insertion side 5, and also two transverse sides 6*d*, 6*e*.

As is clear, inter alia, from the sectional view of FIG. 2 and also from the perspective views of FIG. 1, the plug connector contact carrier 1 in each case has a connecting channel 21 which is routed out laterally and which opens out into an opening 22 on one of the longitudinal sides 6*a*, 6*b*.

Therefore, these connecting channels 21 constitute access points for a screwdriver which can be inserted into the connecting channel 21 from the longitudinal sides 6*a* or 6*b* in order to there turn a screw or a screw terminal 8 and to electrically connect a cable end which is inserted into the connection region of a screw contact element 20 to the screw contact element 20.

Figure 6:
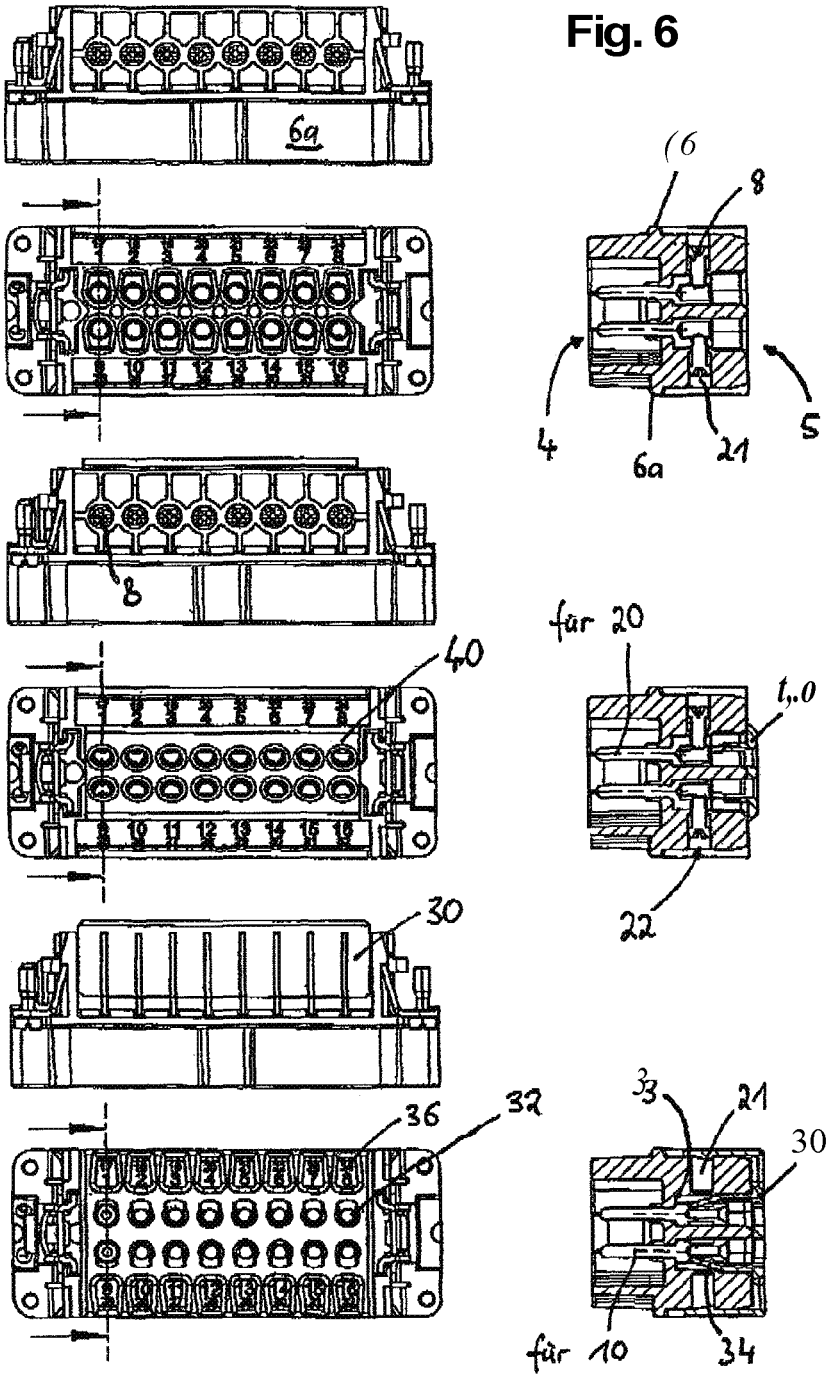
FIG. 6 shows an overview of different views of a plug connector contact carrier according to the invention.

FIG. 6 shows different side views, plan views and sectional views of an embodiment of a plug connector contact carrier 1 according to the invention.

The manner in which the contact chamber 2 is designed and the manner in which the bearing surface 3 which is defined in the contact chambers 2 is fitted is clear from the sectional views in particular.

Figure 4:
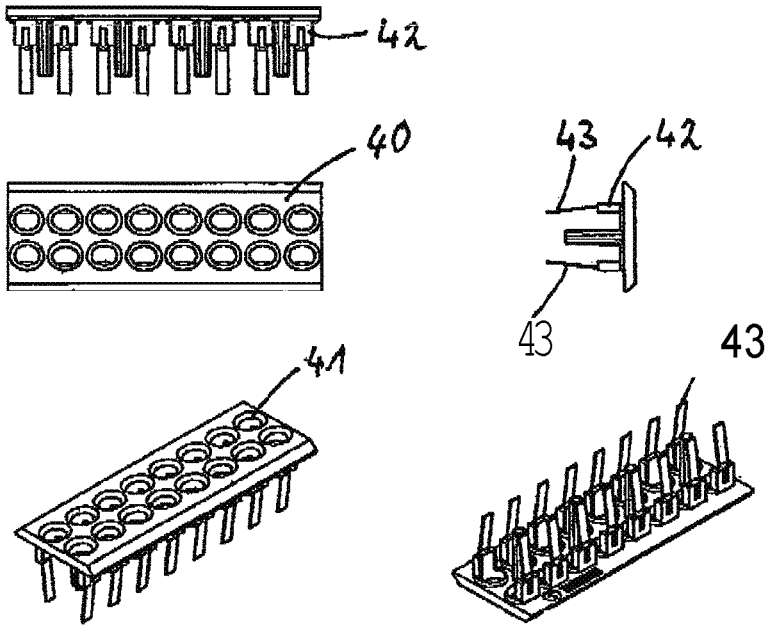
FIG. 4 shows a holding cover which is designed for the screw contact elements in a side view, in a view from above, in a further side view and in a perspective view from above and a perspective view from below.

In the central sectional view of FIG. 6, the plug connector contact carrier 1 is provided with a holding cover 40 according to the invention as illustrated in FIG. 4. The holding cover 40 has openings 41 which are provided in the contact grid of the plug connector contact carrier 1. Furthermore, wire protection means 43 are provided on the bottom of the holding cover 40. The wire protection means 43 inserted into or mounted in receiving elements 42 which are provided on the holding cover 40. The spring sheets 43 project out of the holding cover 40 such that said spring sheets each protrude into the contact chambers 2 in the mounted state of the holding cover 40, as is shown in the central view of FIG. 6.

In the process, the spring sheets 43 and therefore wire protection means 43 project into the contact chamber 2 such that the screw of the screw terminal 8, by way of its end, meets the wire protection means 43 and in this way damage to the wire can be reliably prevented.

As an alternative, the plug connector contact carrier 1 according to the invention can also be used without the above-described holding cover 40, as is shown by way of example in the upper view and in the upper sectional view of FIG. 6.

Figure 3:
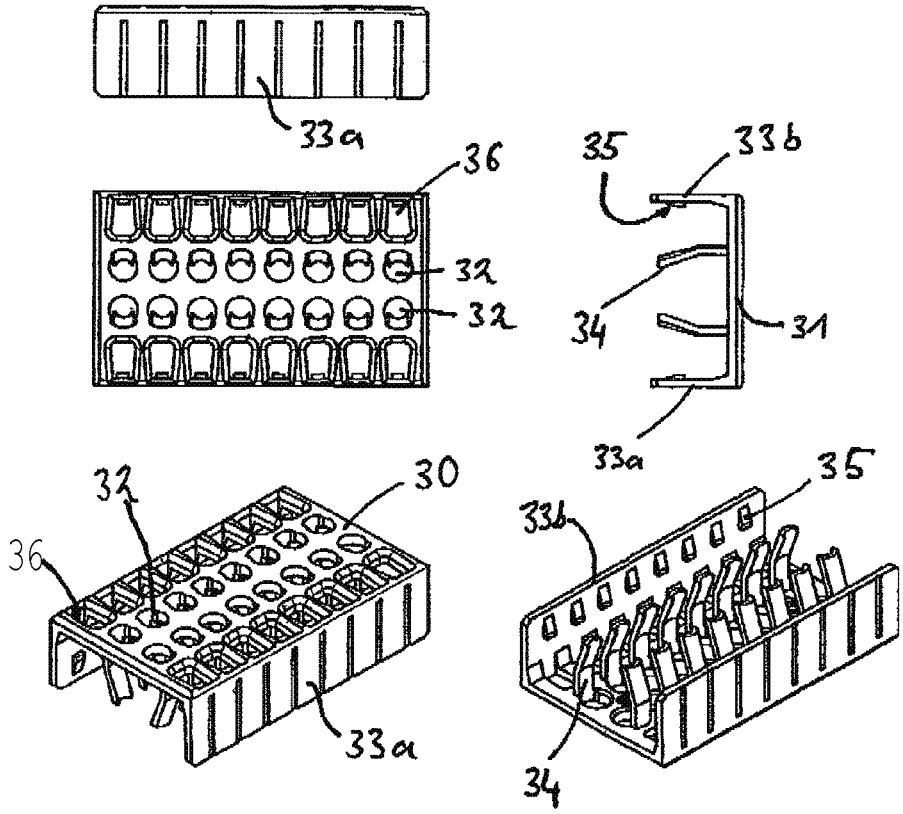
FIG. 3 shows a holding cover which is designed for the crimp contact elements in a perspective view from above, a perspective view from below, a plan view and a sectional view and also a side view.

As an alternative, the plug connector contact carrier 1 according to the invention can also be populated with crimp contact elements 10. A schematic view of this can be found in the lower sectional view of FIG. 6 and in the lower views of FIG. 6. Here, the plug connector contact carrier 1 is provided with a holding cover 30 as shown in FIG. 3.

The holding cover 30 for fixing crimp contact elements 10 in the plug connector contact carrier 1 comprises a head plate 31 on which two limb sides 33*a*, 33*b* are provided on the sides in each case. A respective arm 34 is located between the limb sides 33*a*, 33*b*, adjacent to the openings 32 which are arranged in the head plate 31. The arms 34 are bent and, in their mounted position, protrude into the contact chamber 2 in order to be supported, by way of their insertion-side end, on a latching projection of the crimp contact element 10 there. This ensures that the crimp contact element 10 which is inserted into the contact chamber 2 is securely held in its mounting position. This is implemented, in particular, by the limb sides 33*a*, 33*b* being provided with latching lugs 35 on their sides which face the plug connector contact carrier 1 for the purpose of latching with corresponding latching recesses which are provided on the corresponding longitudinal sides 6*a*, 6*b* of the plug connector contact carrier. In the embodiment of the invention present here, the connecting channels 21 at the same time form the latching recesses for the latching lugs 35.

The for the holding cover 30 for the crimp contact elements 10 further has, in addition to the two rows of openings 32, in each case adjacent to the outer edge, a row of openings 36 through which the above-described contact chamber identification means 7 remain visible when the holding cover 30 is mounted on the plug connector contact carrier 1, as is clear from the lower view of FIG. 6.

Figure 5:
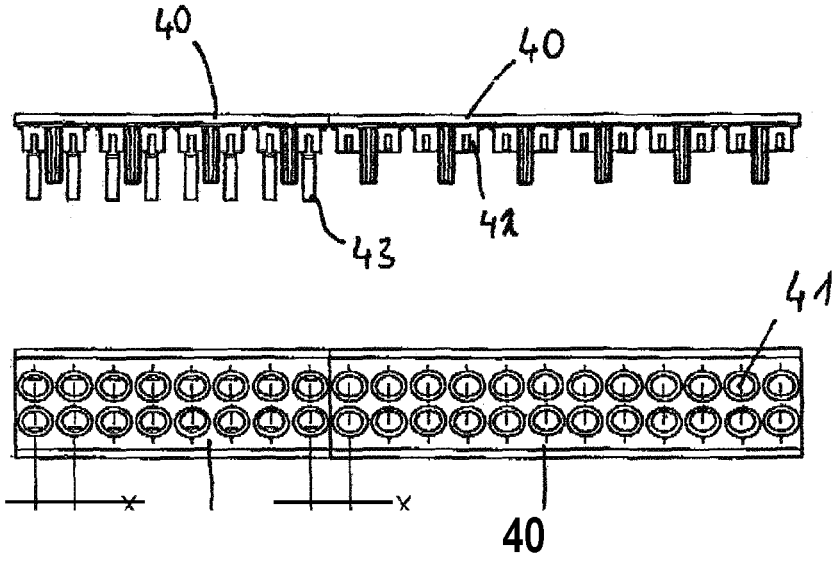
FIG. 5 shows the holding cover shown in FIG. 4 in a lined-up production position.

FIG. 5 shows a further advantageous aspect of the present invention by way of an exemplary embodiment of a holding cover 40 which can be arranged such that it can be lined up. Since mounting the wire protection means 43 in the receiving elements 42 is complicated, the configuration of a corresponding grid of the openings 41 in the holding cover 40 can ensure that different designs of holding covers 40 can be lined up and, by means of lining up in each case between adjacent holding covers, the same contact spacing X is produced, as is the case within a holding cover 40. The tolerances can be captured, in particular, in this way in the longitudinal direction when the openings 41 are in the form of elliptical openings or oval openings in the holding cover 40.

However, the invention is not restricted to the preferred exemplary embodiment of the invention indicated above in respect of its design. Rather, it is possible to provide a number of variants which make use of the illustrated solution even in the case of a fundamentally different kind of embodiment.

LIST OF REFERENCE SYMBOLS

Plug Connector Contact Carrier

1 Plug connector contact carrier
2 Contact chambers
3 Bearing surface
4 End side
5 Contact insertion side
6*a*, 6*b* Longitudinal sides
6*d*, 6*e* Transverse sides
7 Contact chamber identification means
8 Screw terminal
10 Crimp contact element
11 Insertion openings
20 Screw contact element
21 Connecting channel
22 Openings
30 Holding cover for crimp contacts
31 Head plate
32 Openings
33*a*, 33*b* Limb sides
34 Arms
35 Latching lugs
36 Openings
40 Holding cover for screw contacts
41 Openings
42 Receiving elements
43 Wire protection means/spring sheets
X Contact spacing

The invention claimed is:

1. A plug connector contact carrier, comprising:

a plurality of contact chambers to receive contact elements provided in a contact grid, and a plurality of insertion openings, each of which is aligned with each of the plurality of contact chambers for inserting the contact elements into the contact chambers, wherein each of the plurality of contact chambers are configured to receive a crimp contact element and a screw contact element, and selectively receive the crimp contact element or the screw contact element.

2. The plug connector contact carrier of claim 1, wherein each of the plurality of contact chambers has a common bearing surface for the crimp contact element or the screw contact element to bear against.

3. The plug connector contact carrier of claim 1, wherein the plug connector contact carrier has an end side, a contact insertion side opposite the end side, two longitudinal sides which connect the end side and the contact insertion side, and at least one lateral connecting channel having an opening on one of the longitudinal sides and extending to the contact chamber for access thereto.

4. The plug connector contact carrier of claim 1, further comprising at least one detachable holding cover which functions to secure the crimp contact elements that are mounted in the contact carrier.

5. The plug connector contact carrier of claim 4, wherein the holding cover has a head plate with a plurality of openings which are arranged in a contact grid that aligns with the contact grid of the contact carrier.

6. The plug connector contact carrier of claim 5, wherein the holding cover is U-shaped in cross section and has two adjacent limb sides which project away from the head plate in an orthogonal manner.

7. The plug connector contact carrier of claim 5, wherein the holding cover has arms which project away from the holding cover and which are attached to the holding cover at the plurality of openings such that the arms protrude into the contact chambers when the holding cover is mounted to the contact carrier.

8. The plug connector contact carrier of claim 7, wherein the arms have a bent or angled profile.

9. The plug connector contact carrier of claim 7, wherein the arms are arranged between the plurality of openings and the adjacent limb sides.

10. The plug connector contact carrier of claim 6, wherein the adjacent limb sides are provided with latching lugs which face the plug connector contact carrier and which latch to corresponding latching recesses which are provided on longitudinal sides of the plug connector contact carrier.

11. The plug connector contact carrier of claim 5, further comprising a second set of openings in the head plate of the holding cover adjacent to the openings which are arranged in the contact grid.

12. The plug connector contact carrier as claimed in claim 1, further comprising a detachable holding cover having a wire protection means to provide the screw contact elements that are mounted in the contact carrier with wire protection.

13. The plug connector contact carrier of in claim 12, wherein the holding cover has a plurality of openings which are aligned with the contact grid of the plug connector contact carrier.

14. The plug connector contact carrier of claim 13, wherein the holding cover has a plurality of spring sheets that are mounted in receiving elements on the holding cover and which project from the holding cover such that the spring sheets protrude into the contact chambers when the holding cover is mounted to the contact carrier.

15. The plug connector contact carrier of claim 13, wherein the plurality of openings in the holding cover are elliptical openings for which the large half-axes are arranged on a line in the longitudinal extent of the plug connector contact carrier.

16. The plug connector contact carrier as claimed in claim 1, wherein the plurality of contact chambers are arranged in two parallel rows with a fixed contact grid.

* * * * *